US007713330B2

(12) United States Patent
Bohlen et al.

(10) Patent No.: US 7,713,330 B2
(45) Date of Patent: May 11, 2010

(54) TOWER IONIZER AIR CLEANER

(75) Inventors: John R. Bohlen, Biloxi, MS (US); Thomas A. Oreck, New Orleans, LA (US); Bruce Kiern, Gulfport, MS (US); Christopher M. Paterson, Biloxi, MS (US); Charles W. Reynolds, Long Beach, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 212 days.

(21) Appl. No.: 11/023,113

(22) Filed: Dec. 22, 2004

(65) Prior Publication Data

US 2006/0130657 A1 Jun. 22, 2006

(51) Int. Cl.
*B03C 3/011* (2006.01)
*B03C 3/36* (2006.01)

(52) U.S. Cl. ..... 95/2; 55/470; 55/472; 95/23; 95/78; 96/18; 96/25; 96/30; 96/31; 96/63; 96/397; 96/424

(58) Field of Classification Search ..... 96/18, 96/25, 30, 31, 63, 397, 424, 2, 19–24; 422/186.04; 55/470, 472; 95/2, 23, 78, 3–7
See application file for complete search history.

(56) References Cited

U.S. PATENT DOCUMENTS 3,080,695 A * 3/1963 Hay ..... 55/470
3,495,381 A * 2/1970 Flanagan ..... 96/63
3,722,183 A * 3/1973 Gaylord ..... 96/63
4,244,712 A 1/1981 Tongret ..... 96/25
4,253,852 A 3/1981 Adams ..... 96/58
4,255,176 A 3/1981 Macrow ..... 55/415
4,390,831 A * 6/1983 Byrd et al. ..... 323/240
4,473,382 A 9/1984 Cheslock ..... 96/58

(Continued)

FOREIGN PATENT DOCUMENTS

DE 36 18 403 A1 12/1987

(Continued)

OTHER PUBLICATIONS

The Friedrich C-90A Electronic Air Cleaner, How the C-90A Works, [online], [retrieved on Apr. 12, 2004] Retrieved from the BestAirCleaner.com website using Internet <URL:http://www.bestaircleaner.com/faq/c90works.asp>.

(Continued)

*Primary Examiner*—Richard L Chiesa
(74) *Attorney, Agent, or Firm*—Winston & Strawn LLP

(57) ABSTRACT

A tower ionizer air cleaner is provided. The tower ionizer air cleaner includes a tower chassis, with a base of the tower chassis including a small footprint, one or more airflow inlet openings in the tower chassis, one or more airflow outlet openings in the tower chassis and substantially opposite to the one or more airflow inlet openings, and an ionizer element positioned within the tower chassis. The tower ionizer air cleaner further includes one or more fan units substantially vertically located within the tower ionizer air cleaner and affixed to the tower chassis. The one or more fan units are configured to provide an airflow between the one or more airflow inlet openings and the one or more airflow outlet openings and through the ionizer element.

58 Claims, 5 Drawing Sheets

U.S. PATENT DOCUMENTS

| | | | | | |
|---|---|---|---|---|---|
| 4,516,991 | A | | 5/1985 | Kawashima | 96/55 |
| 4,737,173 | A | * | 4/1988 | Kudirka et al. | 96/131 |
| 4,811,197 | A | | 3/1989 | Wexler | 700/47 |
| 5,268,009 | A | | 12/1993 | Thompson et al. | 96/67 |
| 5,330,559 | A | | 7/1994 | Cheney et al. | 95/63 |
| 5,660,605 | A | | 8/1997 | Chan et al. | 96/19 |
| 5,679,137 | A | | 10/1997 | Erdman et al. | 96/26 |
| 5,702,507 | A | | 12/1997 | Wang | 96/55 |
| 5,980,614 | A | * | 11/1999 | Loreth et al. | 96/63 |
| 6,118,645 | A | | 9/2000 | Partridge | 361/231 |
| 6,129,781 | A | * | 10/2000 | Okamoto et al. | 96/25 |
| 6,156,088 | A | | 12/2000 | Cardarelli | 55/385.8 |
| 6,174,340 | B1 | | 1/2001 | Hodge | 55/385.1 |
| 6,176,977 | B1 | * | 1/2001 | Taylor et al. | 204/176 |
| 6,398,852 | B1 | * | 6/2002 | Loreth | 96/63 |
| 6,413,302 | B1 | | 7/2002 | Harrison et al. | 96/63 |
| 6,428,611 | B1 | * | 8/2002 | Andolino et al. | 96/25 |
| 6,471,752 | B1 | * | 10/2002 | Lewis | 96/20 |
| 6,616,736 | B2 | * | 9/2003 | Massey et al. | 96/25 |
| 6,713,026 | B2 | | 3/2004 | Taylor et al. | 422/186.04 |
| 6,926,762 | B2 | * | 8/2005 | Kim et al. | 96/397 |
| 6,951,582 | B1 | * | 10/2005 | Tsai et al. | 96/18 |
| 7,081,152 | B2 | * | 7/2006 | Altman et al. | 95/5 |
| 2001/0029728 | A1 | | 10/2001 | Massey et al. | 55/471 |
| 2001/0029842 | A1 | * | 10/2001 | Hoenig | 96/63 |
| 2003/0206837 | A1 | * | 11/2003 | Taylor et al. | 422/186 |
| 2003/0209420 | A1 | * | 11/2003 | Taylor et al. | 204/164 |
| 2004/0001786 | A1 | * | 1/2004 | Jan | 422/306 |
| 2004/0118288 | A1 | * | 6/2004 | Kim et al. | 96/417 |
| 2004/0123739 | A1 | * | 7/2004 | Jan | 96/18 |
| 2005/0183576 | A1 | * | 8/2005 | Taylor et al. | 96/16 |

FOREIGN PATENT DOCUMENTS

| | | | |
|---|---|---|---|
| DE | 3618403 | A1 | 12/1987 |
| EP | 0 644 379 | A | 3/1995 |
| EP | 93830388.0 | | 3/1995 |
| GB | 2 265 557 | A | 6/1993 |
| GB | 2 265 557 | A | 10/1993 |

OTHER PUBLICATIONS

LifeWise™ Environizer™ Full-sized Electronic Air Purifier product information, [online], [retrieved on Apr. 13, 2004] Retrieved from the radioshack.com website using Internet <URL:http://www.radioshack.com/product.asp?catalog%5Fname=CTLG &category%5Fname=CTLG%5F010%5F002%5F001%5F000 &product%5Fid=63%2D1532>.

LifeWise™ Environizer™ Compact Electronic Air Purifier product information, [online], [retrieved on Apr. 13, 2004] Retrieved from the radioshack.com website using Internet <URL:http://www.radioshack.com/product.asp?catalog%5Fname=CTLG &category%5Fname=CTLG%5F010%5F002%5F001%5F000 &product%5Fid=63%2D1533>.

Holmes Model# HAP422-U 99% Hepa Tower Air Purifier proudct information, [online], [retrieved on Apr. 13, 2004] Retrieved from the homesproducts.com website using Internet <URL:http://www.holmesproducts.com/eStore/product.aspx?CatalogID=3 &CategoryId=1138&ProductId=8188>.

Bionaire® Model#BAP825-U 99% Hepa Tower Air Purifier product information, [online], [retrieved on Apr. 13, 2004] Retrieved from the Bionaire.com website using Internet <URL:http://www.bionaire.com/eStore/product.aspx?CatalogId=1&CategoryId=1232 &ProductId=9962>.

Bionaire® Model#BT45RC-UC Remote Control Tower Fan product information, [online], [retrieved on Apr. 13, 2004] Retrieved from the Bionaire.com website using Internet <URL:http://www.bionaire.com/eStore/product.aspx?CatalogId=1&CategoryId=1112 &ProductId=7917>.

Deluxe Spire Feel-Good Fan withNegative-Ion Feature product information, [online], [retrieved on Apr. 13, 2004] Retrieved from the sharperimage.com website using Inernet <URL:http://www.sharperimage.corn/us/en/catalog/productview.jhtml?sku=SI698BRL>.

Ionic Breeze Quadra Compact Silent Air Purifier #SI697GRY product information, [online], [retrieved on Apr. 13, 2004] Retrieved from the sharperimage.com website using Internet <URL: http://www.sharperimage.com/us/en/catalog/productview/sku=SI697SNX/catId=101/pcatid=1>.

Ionic Breeze GP Silent Air Purifier with Ultraviolet Germicidal Proection #SI730GYB product information, [online], [retrieved on Apr. 13, 2004] Retrieved from the sharperimage.com website using Internet <URL:http://www.sharperimage.corn/us/en/catalog/productview.jhtml?pid=37143300&pcatId=1...>.

Ionic Breeze Quadra Silent Air Purifier #SI637SNX product information, [online], [retrieved on Apr. 13, 2004] Retrieved from the sharperimage.com website using Internet <URL:http://www.sharperimage.com/us/en/catalog/productview/sku=SI697SNX/catid=101/pcatid=1>.

Ionic Breeze GP Desktop with Ultraviolet Germicidal Protection #SI720BRL product information, [online], [retrieved on Apr. 13, 2004] Retrieved from the sharperimage.com website using Internet <URL:http://www.sharperimage.com/us/en/catalog/productview.jhtml?sku=SI720BRL>.

LifeWise™ Environizer™ Ultra Electronic Air Purifier product information, [online], [retrieved on Apr. 13, 2004] Retrieved from the radioshack.com website using Internet <URL:http://www.radioshack.com/product.asp?catalog%5Fname=CTLG &category%5Fname=C...>.

Super Air 7 Air Purifier product Information, [online], [retrieved on Apr. 12, 2004], Retrieved from the Oreck.com website using Internet <URL: http://www.oreck.com/air-purifiers/super-air7.cfm>.

Pure-Ion™ UV Air Purifier Brookstone sku# 425629 product Information, [online], [retrieved on Apr. 13, 2004] Retrieved from the brookstone.com website using Internet <URL: http://www.brookstone.com/shop/thumbnail.asp?world_code=2 &category_code=66&subcategory_code=143 &cmid=hdrdrop_2_66_143&search_type=subcateqory &cm_re=Hdr*NAV*home>.

* cited by examiner

TOWER IONIZER AIR CLEANER

TECHNICAL FIELD

The present invention relates to an air cleaner, and more particularly, to a tower ionizer air cleaner.

BACKGROUND OF THE INVENTION

Air cleaners and purifiers are widely used for removing foreign substances from air. The foreign substances can include pollen, dander, smoke, pollutants, dust, etc. In addition, an air cleaner can be used to circulate room air. An air cleaner can be used in many settings, including at home, in offices, etc.

One type of air cleaner is an electrostatic precipitator. An electrostatic precipitator operates by creating an electrical field. Dirt and debris in the air becomes ionized when it is brought into the electrical field by an airflow. Charged positive and negative electrodes in the electrostatic precipitator air cleaner, such as positive and negative plates, attract the ionized dirt and debris. The electrodes can release the dirt and debris when not powered, allowing the accumulated dirt and debris to drop into a catch basin. In addition, the electrostatic precipitator can typically be removed and cleaned. Because the electrostatic precipitator comprises electrodes or plates through which airflow can easily and quickly pass, only a low amount of energy is required to generate the airflow. As a result, foreign objects in the air can be efficiently and effectively removed without the need for a mechanical filter element.

One type of electrostatic precipitator includes an electrostatic air moving mechanism that creates electrical field pulses in order to charge (i.e., ionize) the air. The device alternatingly charges and repulses the surrounding air in order to create air movement. However, although the resulting airflow is quiet, it is also very weak, and such air cleaner systems take a very long time to cycle through an average room air volume. In addition, an electrostatic air movement does not allow much control over the airflow volume, and is an on or off type of air movement system.

Another type of electrostatic precipitator is offered for sale by Brookstone, Inc., Nashua, N.H. The Brookstone air cleaner includes a single fan that draws air in at the base, ducts the airflow to the top of the tower, and draws the airflow down through an elongate electrostatic precipitator. The Brookstone electrostatic precipitator is tall and narrow, and the downward airflow travels the height of the electrostatic precipitator. The airflow is ultimately exhausted at a port in the base.

This prior art device has several drawbacks. The long, serpentine airflow path results in airflow energy loss due to its length and its corners. In addition, the long, looping airflow path can cause increased noise of operation. Moreover, the airflow is constrained to travel the full height of the electrostatic precipitator, reducing the contact of the electrostatic precipitator with the airflow and impairing the efficiency of the prior art device.

SUMMARY OF THE INVENTION

A tower ionizer air cleaner is provided according to an embodiment of the invention. The tower ionizer air cleaner comprises a tower chassis, with a base of the tower chassis including a small footprint, one or more airflow inlet openings in the tower chassis, and one or more airflow outlet openings in the tower chassis and substantially opposite to the one or more airflow inlet openings. The tower ionizer air cleaner further comprises an ionizer element positioned within the tower chassis and two or more fan units located within the tower ionizer air cleaner and affixed to the tower chassis. The two or more fan units are configured to provide an airflow between the one or more airflow inlet openings and the one or more airflow outlet openings and through the ionizer element.

A method of operating a tower ionizer air cleaner is provided according to an embodiment of the invention. The method comprises receiving user inputs through a control interface, operating an ionizer element and two or more fan units according to the user inputs, wherein the two or more fan units provide airflow through the ionizer element, storing current operational settings for the air cleaner, and recalling the current operational settings and resuming operation of the air cleaner at the current operational settings upon an electrical power interruption.

A tower ionizer air cleaner is provided according to an embodiment of the invention. The tower ionizer air cleaner comprises a tower chassis, with a base of the tower chassis including a small footprint, one or more airflow inlet openings in the tower chassis, and one or more airflow outlet openings in the tower chassis and substantially opposite to the one or more airflow inlet openings. The tower ionizer air cleaner further comprises an ionizer element positioned within the tower and a fan unit located within the tower ionizer air cleaner and affixed to the tower chassis. The fan unit is configured to provide a substantially horizontal airflow between the one or more airflow inlet openings and the one or more airflow outlet openings and through the ionizer element.

A method of operating a tower ionizer air cleaner is provided according to an embodiment of the invention. The method comprises receiving user inputs through a control interface, operating an ionizer element and a fan unit according to the user inputs, wherein the fan unit provides a substantially horizontal airflow through the ionizer element, storing current operational settings for the air cleaner, and recalling the current operational settings and resuming operation of the air cleaner at the current operational settings upon an electrical power interruption.

BRIEF DESCRIPTION OF THE DRAWINGS

The same reference number represents the same element on all drawings. It should be noted that the drawings are not necessarily to scale.

DETAILED DESCRIPTION OF THE INVENTION

FIGS. 1-5 and the following descriptions depict specific embodiments to teach those skilled in the art how to make and use the best mode of the invention. For the purpose of teaching inventive principles, some conventional aspects have been simplified or omitted. Those skilled in the art will appreciate variations from these embodiments that fall within the scope of the invention. Those skilled in the art will also appreciate that the features described below can be combined in various ways to form multiple variations of the invention. As a result, the invention is not limited to the specific embodiments described below, but only by the claims and their equivalents.

Figure 1:
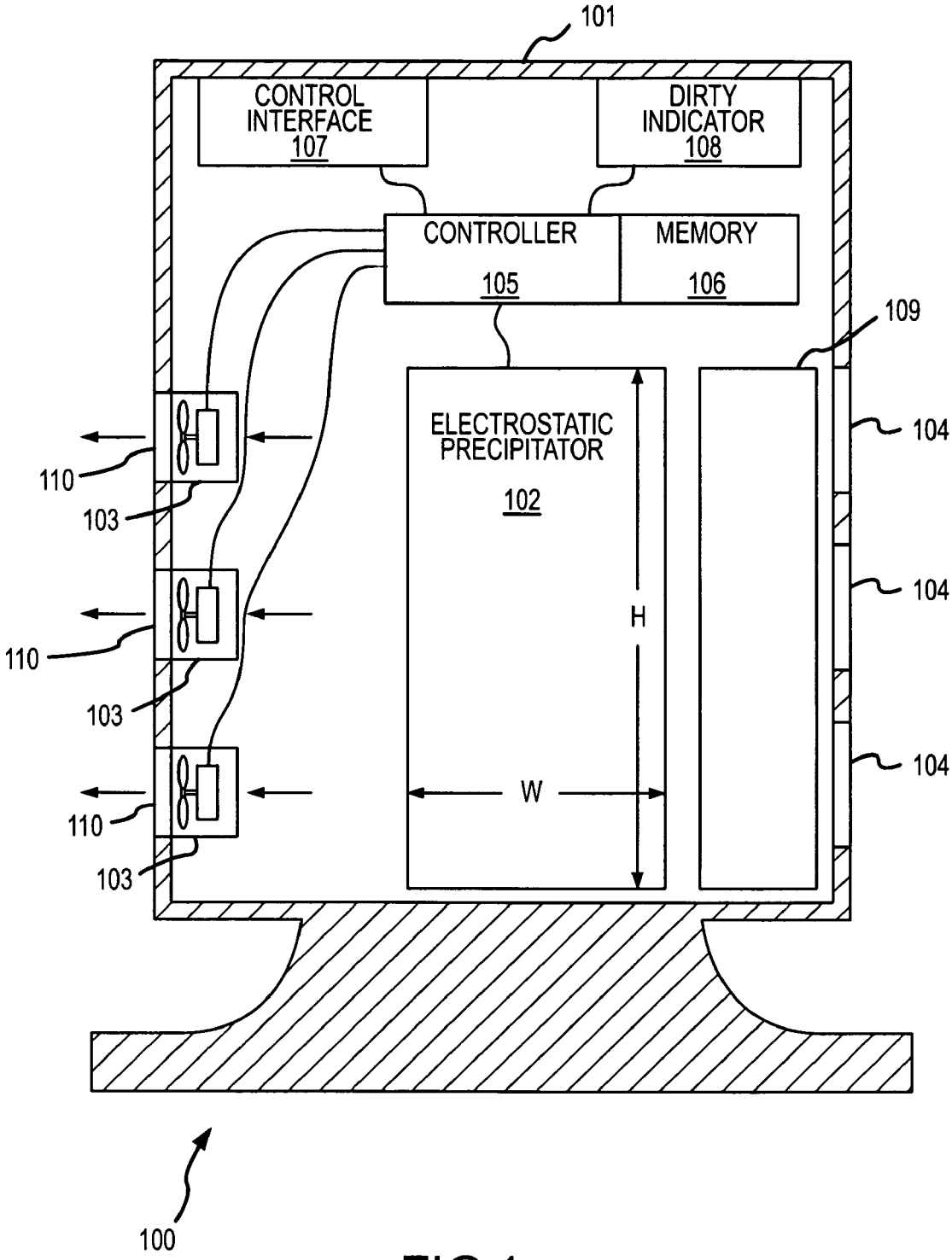
FIG. 1 shows a tower ionizer air cleaner according to an embodiment of the invention.

FIG. 1 shows a tower ionizer air cleaner 100 according to an embodiment of the invention. The air cleaner 100 includes a tower chassis 101 with a base of the tower chassis 101 including a small footprint, one or more airflow inlet openings 104 in the tower chassis 101, and one or more airflow outlet openings 110 in the tower chassis 101 and substantially opposite to the one or more airflow inlet openings 104. The inlet and outlet openings 104 and 110 can comprise apertures, slots, grills, screens, etc. The inlet and outlet openings 104 and 110 operate to allow the airflow to flow through the tower chassis 101 and can allow the airflow to flow substantially horizontally through the tower chassis 101. The inlet and outlet openings 104 and 110 in one embodiment are substantially vertically located, as shown. Alternatively, the inlet and outlet openings 104 and 110 can be staggered, offset, etc. The tower ionizer air cleaner 100 further includes an ionizer element 102, one or more fan units 103, and a controller 105, all located within the tower chassis 101. The ionizer element 102 can comprise an electrostatic precipitator or other air cleaning device that employs an electrical field. The ionizer element 102 in one embodiment includes a width W and a height H that is greater than the width W. Consequently, the ionizer element 102 can be elongate in shape, such as a rectangular or oval shape, for example. However, it should be understood that the ionizer element 102 can be of any shape, and the above shapes are given merely as examples and are not limiting. In addition, the ionizer element 102 can comprise planar electrodes. However, it should be understood that the electrodes can be of any desired shape.

In operation, when the tower ionizer air cleaner 100 is activated, the one or more fan units 103 generate an airflow through the tower chassis 101 and through the ionizer element 102. The airflow can be substantially horizontal. The airflow therefore traverses the width W of the ionizer element 102, and not the height H. In this manner, the effective area of the ionizer element 102 receives a maximum airflow volume for most efficient cleaning of the airflow. In addition, the straight airflow path through the tower ionizer air cleaner 100 reduces the amount of electrical power needed to achieve the airflow, reduces turbulence, and can reduce airflow noise. Moreover, the size of the tower chassis 101 can be reduced, as there is no need for a serpentine air channel running up and down through the tower ionizer air cleaner 100.

It should be noted that the airflow can travel from right to left, as shown. Alternatively, the tower ionizer air cleaner 100 can be configured wherein the airflow travels from left to right, wherein the inlet 104 and the outlet 110 are reversed from those shown in the figure.

The controller 105 controls operations of the tower ionizer air cleaner 100. The controller 105 can enable and disable a fan unit of the one or more fan units 103 and can enable and disable the ionizer element 102. The controller 105 can include a processor or specialized circuitry that receives inputs, consults operational settings, and controls operations of the air cleaner 100. In addition, the controller 105 can include a memory 106 that can be used to store operational settings and a control routine, among other things. For example, the memory 106 can store one or more fan speed settings, can store on/off states for the fan units 103 and the ionizer element 102, can store user inputs received from the control interface 107, etc. In one embodiment, the memory 106 comprises a non-volatile memory, wherein the contents of the memory remain even over a power cycle or electrical power interruption.

In one embodiment, the controller 105 is configured to store current operational settings and resume operation of the air cleaner 100 at the current operational settings upon an electrical power interruption. In another embodiment, the controller 105 is configured to receive the user inputs from the control interface 107, operate the one or more fan units 103 and the ionizer element 102 according to the user inputs, and store current operational settings and resume operation of the air cleaner 100 at the current operational settings upon an electrical power interruption (see FIG. 2). In yet another embodiment, the controller 105 is configured to store current operational settings, operate the one or more fan units 103 at a predetermined kickstart airflow level for a predetermined startup time period after the electrical power interruption, and operate the air cleaner 100 at the stored current operational settings after the predetermined startup time period (see FIG. 3). In yet another embodiment, the controller 105 is configured to store current operational settings and is configured to operate the one or more fan units 103 at a predetermined kickstart airflow level if the one or more fan units 103 were operating at a low airflow setting before the electrical power interruption (see FIG. 4). The controller 105 in this embodiment is further configured to operate the air cleaner 100 at the stored current operational settings after the predetermined startup time period.

The predetermined startup time period can be on the order of seconds, if desired. The predetermined kickstart airflow level can comprise any airflow level. In one embodiment, the predetermined kickstart airflow level comprises a medium airflow level, whereupon if the power interruption occurs when the air cleaner 100 is at a low airflow level setting, the air cleaner 100 will resume operation at a medium airflow kickstart level for the predetermined startup time period before reverting back to operating at the low airflow level setting.

The one or more fan units 103 include motors and impellers that provide the airflow. It should be understood that the one or more fan units 103 can comprise only one fan unit (see FIG. 5), or can comprise multiple fan units 103, such as the three fan units 103 shown in the current figure. Multiple, vertically spaced fan units 103 enable substantially horizontal airflow through the air cleaner 100. The one or more fan units 103 eliminate the need for costly and space-consuming ducting and serve to increase the available area of the inlet and outlet openings. Therefore, by enlarging the available area of inlet and outlet openings, the air resistance is reduced.

The controller 105 is coupled to the one or more fan units 103 and to the ionizer element 102, and can control the operation of the two components. For example, the controller 105 can turn the ionizer element 102 on and off and can turn the one or more fan units 103 on and off. In some embodiments, the controller 105 can control the speed of a fan unit 103.

In an embodiment that includes multiple fan units 103, the controller 105 can collectively or individually control the fan units 103. For example, the controller 105 in one embodiment controls the collective speed of all fan units 103, and can vary the fan speed over a continuous range, or can set fan speeds at specific values, such as low, medium, and high fan speeds, for example. Alternatively, in another embodiment the controller 105 can control airflow by activating specific individual fan units 103. For a low airflow setting in this embodiment, the controller 105 can activate only a single fan unit. For a medium airflow setting, the controller 105 can activate two fan units 103, etc.

The tower ionizer air cleaner 100 can additionally include a control interface 107 and a dirty indicator 108 that are also coupled to the controller 105. In addition, the air cleaner 100 can include any manner of pre- or post-filter 109 that additionally mechanically filters the airflow. The pre- or post-filter 109 can be located in the airflow anywhere before or after the ionizer element 102.

The control interface 107 comprises an input control panel for use by a user in order to control the tower ionizer air cleaner 100. The control interface 107 can include any manner of input devices, including switches, buttons, keys, etc., that enable the user to control operation of the air cleaner 100. In addition, the control interface 107 can optionally include output devices, such as indicators (including the dirty indicator 108 discussed below), output screens or displays, etc.

The dirty indicator 108 visually indicates a dirty condition to a user. The dirty indicator 108 can comprise any manner of visual indicator, such as a mechanical flag, paddle, signal, or symbol, for example. Alternatively, the dirty indicator 108 can comprise a light, such as an incandescent or fluorescent light element or a light emitting diode (LED), for example. The dirty indicator 108 is actuated when the ionizer element 102 is dirty, and therefore the dirty indicator 108 signals to a user that the air cleaner 100 needs to be cleaned. The dirty indicator 108 can be actuated upon any manner of dirty ionizer element determination. In one embodiment, the dirty indicator 108 is actuated after a predetermined elapsed time period, such as 720 hours of operation of the air cleaner 100, for example. However, other time periods can be employed.

Figure 2:
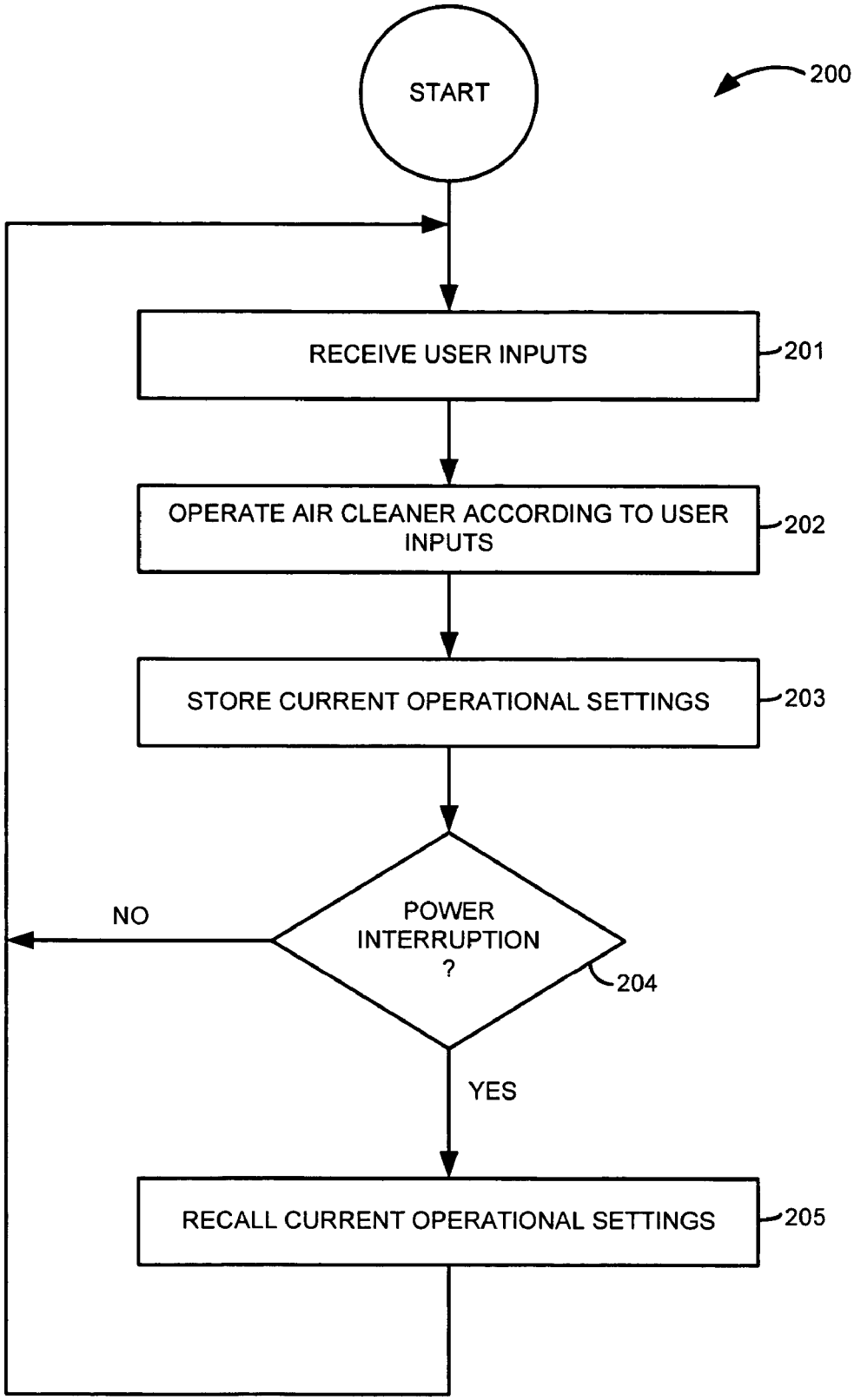
FIG. 2 is a flowchart of a method of operating the tower ionizer air cleaner according to an embodiment of the invention.

FIG. 2 is a flowchart 200 of a method of operating the tower ionizer air cleaner 100 according to an embodiment of the invention. In step 201, user inputs for the air cleaner 100 are received. The user inputs can be received in a controller 105, for example, and can be inputted through a control interface 107.

In step 202, the air cleaner 100 is operated according to the received user inputs. The user inputs can include fan speed settings, fan enable states, ionizer element enable states, etc.

In step 203, the current operational settings of the air cleaner 100 are stored. The current operational settings can be stored in any manner of memory. The current operational settings can be continuously stored, such as in a circular queue, for example. Alternatively, the current operational settings can be periodically stored or stored upon any change in settings.

In step 204, the air cleaner 100 determines whether there has been a power interruption in electrical power provided to the air cleaner 100. The determination can be made in one embodiment by detecting a power-up state in the controller 105. Alternatively, the controller 105 can detect a voltage level below a predetermined threshold. If a power interruption has occurred, the method proceeds to step 205; otherwise it loops back to step 201.

In step 205, the air cleaner 100 recalls the current (i.e., stored) operational settings and resumes operation of the air cleaner 100 and the current operational settings. In this manner, a power interruption does not interfere with the operation, and a temporary power drop or power interruption will not disable or modify the operation of the air cleaner 100.

Figure 3:
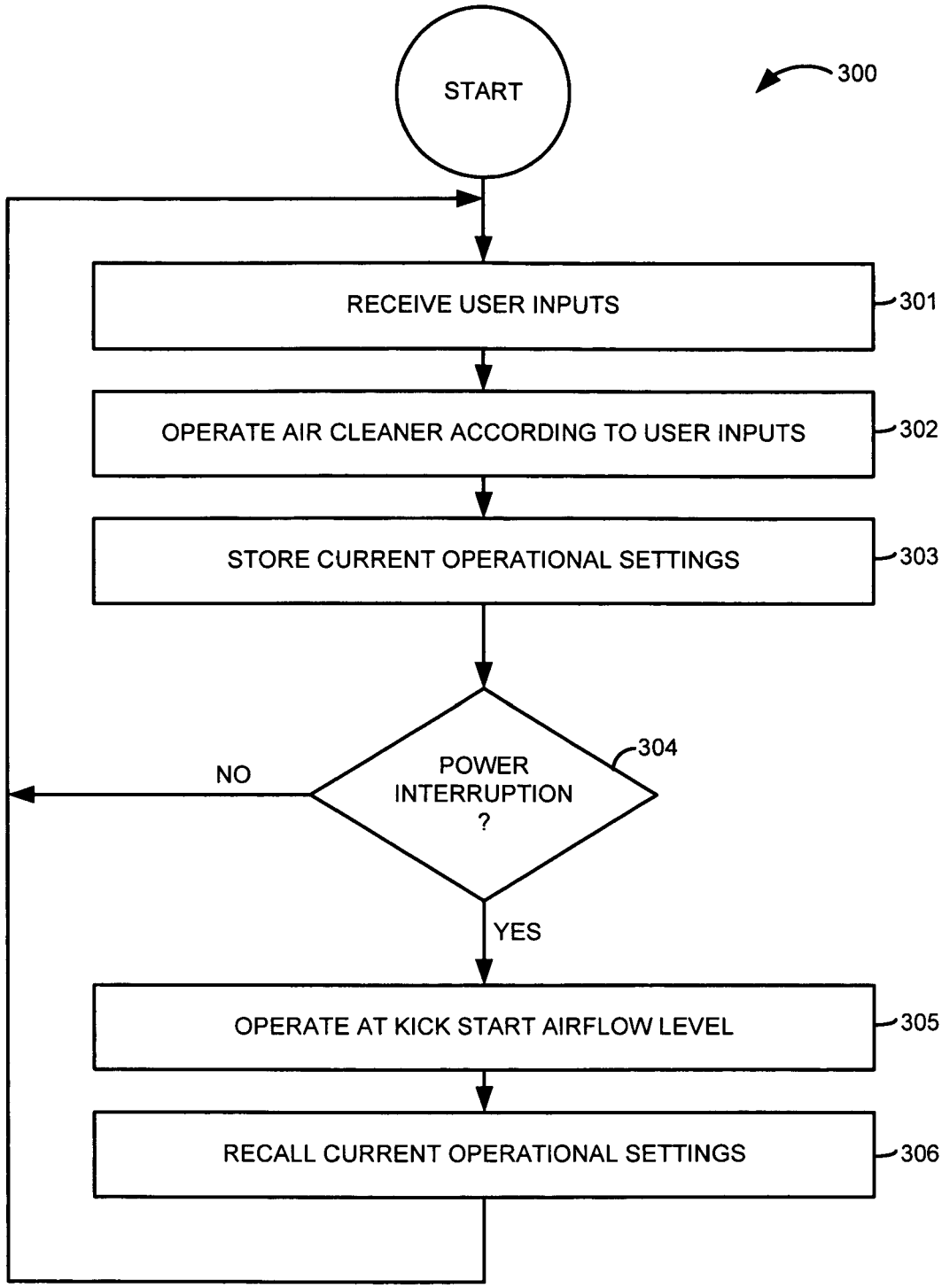
FIG. 3 is a flowchart of a method of operating the tower ionizer air cleaner according to another embodiment of the invention.

FIG. 3 is a flowchart 300 of a method of operating the tower ionizer air cleaner 100 according to another embodiment of the invention. In step 301, user inputs for the air cleaner 100 are received, as was previously discussed.

In step 302, the air cleaner 100 is operated according to the received user inputs, as was previously discussed.

In step 303, the current operational settings of the air cleaner 100 are stored, as was previously discussed.

In step 304, the air cleaner 100 determines whether there has been a power interruption, as was previously discussed. If a power interruption has occurred, the method proceeds to step 305; otherwise it loops back to step 301.

In step 305, the air cleaner 100 operates at a kickstart airflow level for a startup time period. The kickstart airflow level can comprise a default airflow level, such as a medium airflow level in one embodiment. The startup time period can comprise any desired time period. For example, the air cleaner 100 can operate at the kickstart airflow level for about 2 seconds. However, it should be understood that the startup time period and the kickstart airflow level can be set at any desired time length and airflow level.

In step 306, the air cleaner 100 recalls the current (i.e., stored) operational settings and resumes operation of the air cleaner 100 and the current operational settings, as was previously discussed.

Figure 4:
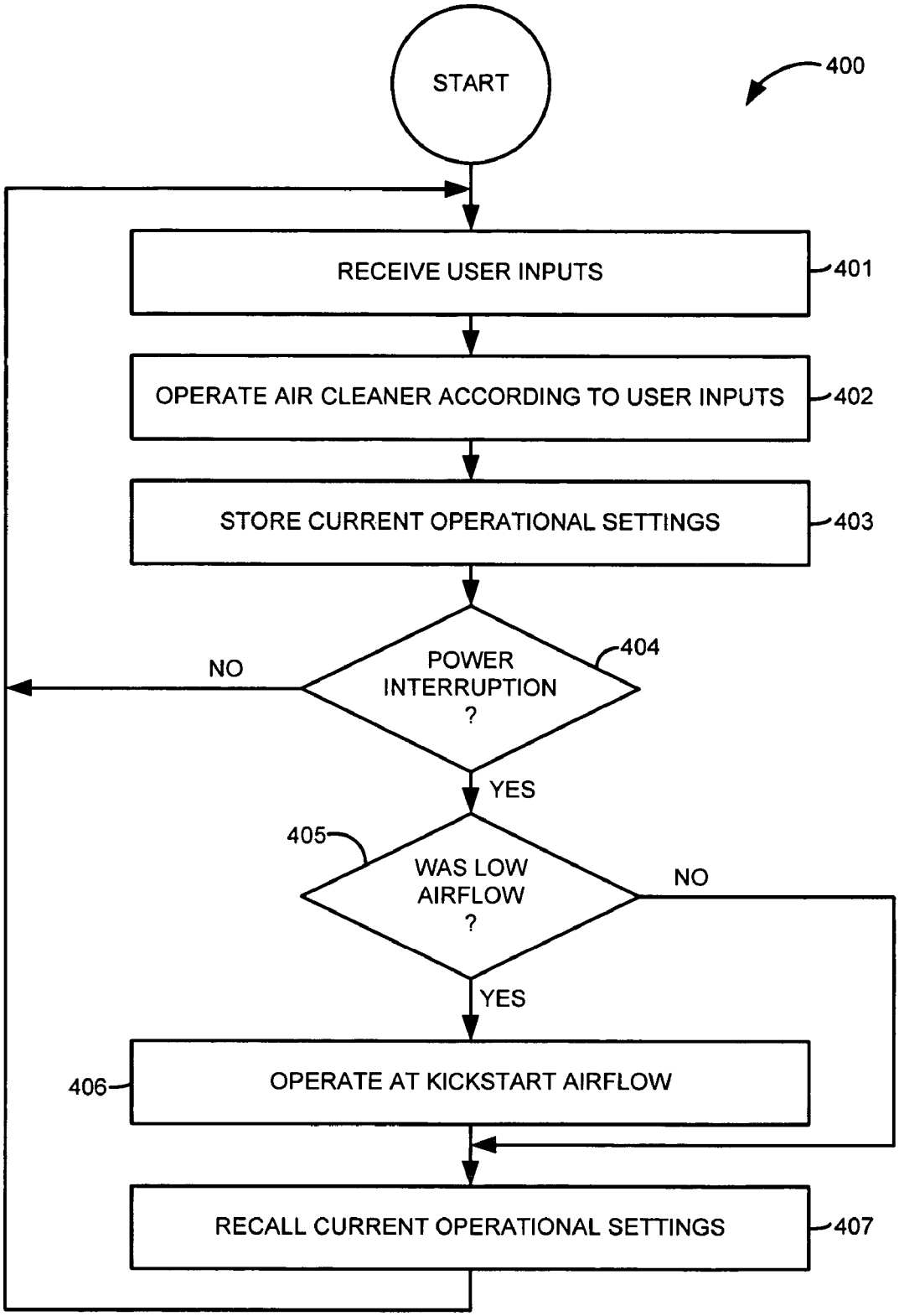
FIG. 4 is a flowchart of a method of operating the tower ionizer air cleaner according to yet another embodiment of the invention.

FIG. 4 is a flowchart 400 of a method of operating the tower ionizer air cleaner 100 according to yet another embodiment of the invention. In step 401, user inputs for the air cleaner 100 are received, as was previously discussed.

In step 402, the air cleaner 100 is operated according to the received user inputs, as was previously discussed.

In step 403, the current operational settings of the air cleaner 100 are stored, as was previously discussed.

In step 404, the air cleaner 100 determines whether there has been a power interruption, as was previously discussed. If a power interruption has occurred, the method proceeds to step 405; otherwise it loops back to step 401.

In step 405, the air cleaner 100 determines if the airflow level before the power interruption was a low airflow level. If it was a low airflow level, the method proceeds to step 406; otherwise the method jumps to step 407 and does not perform a kickstart airflow.

In step 406, the air cleaner 100 operates at a kickstart airflow level for a startup time period, as was previously discussed.

In step 407, the air cleaner 100 recalls the current (i.e., stored) operational settings and resumes operation of the air cleaner 100 and the current operational settings, as was previously discussed.

Figure 5:
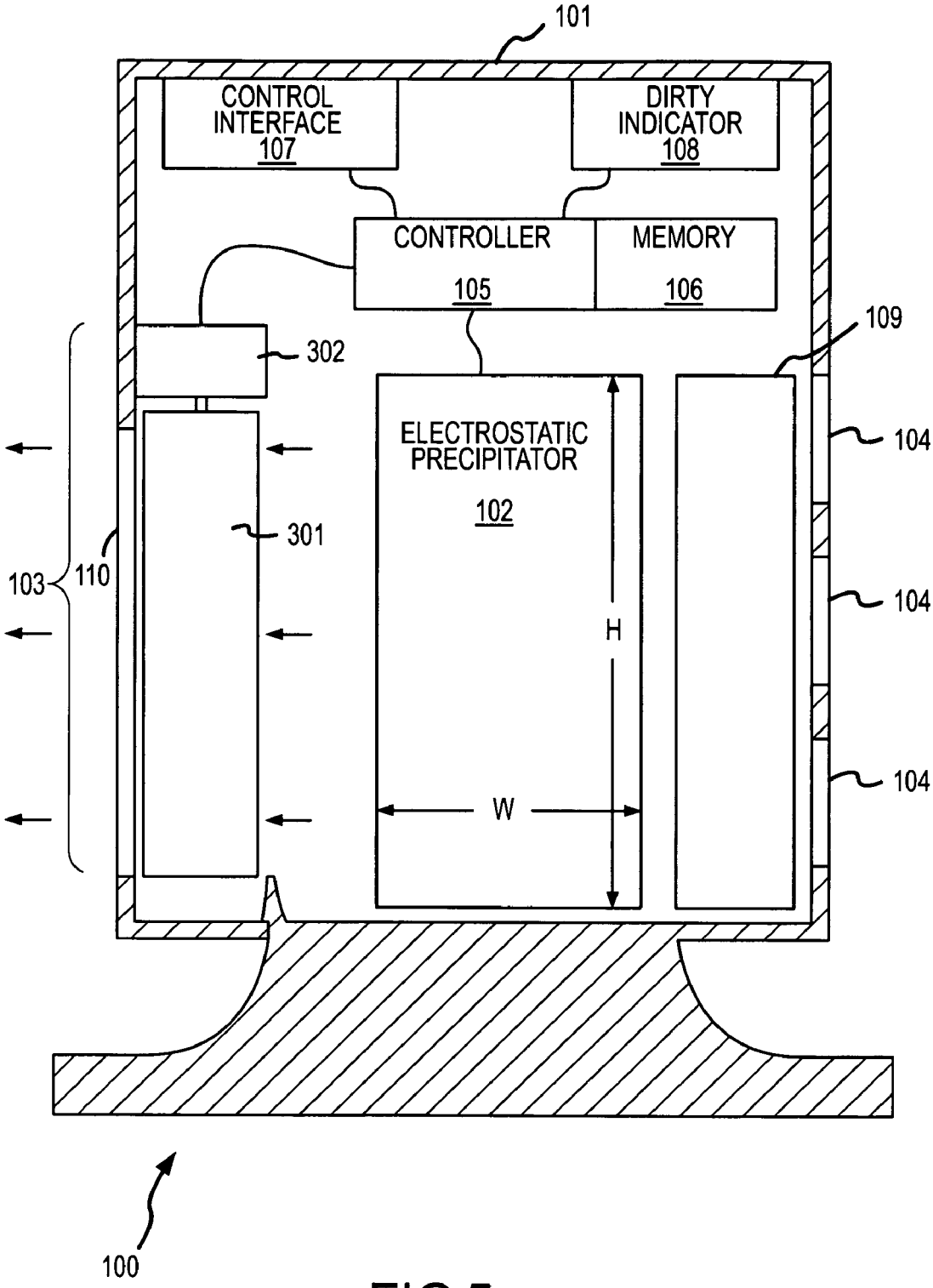
FIG. 5 shows the tower ionizer air cleaner according to another embodiment of the invention.

FIG. 5 shows the tower ionizer air cleaner 100 according to another embodiment of the invention. Components in common with FIG. 1 share the same reference numbers. The air cleaner 100 in this embodiment includes a single fan unit 103, comprising an elongate squirrel cage impeller 301 and motor 302. The airflow is drawn through the inlet openings 104, across the electrostatic precipitator 102, and travels substantially horizontally through the squirrel cage impeller 301 and is expelled through the outlet openings 110. The airflow leaving the squirrel cage impeller 301 travels substantially horizontally, as in the first embodiment. This configuration enables the use of only a single fan unit 103 in order to create the substantially horizontal airflow through the air cleaner 100.

The tower ionizer air cleaner 100 according the invention can be implemented according to any of the embodiments in order to obtain several advantages, if desired. The invention can provide an effective and efficient ionizer air cleaner device. The effective area of the ionizer element 102 receives a maximum airflow volume for most efficient cleaning of the airflow. In addition, the straight, substantially horizontal airflow path through the tower ionizer air cleaner 100 reduces the amount of electrical power needed to achieve the airflow, reduces turbulence, and can reduce airflow noise. Moreover, the size of the tower chassis 101 can be reduced, as there is no need for a serpentine air channel up and down through the tower ionizer air cleaner 100. As a result, the footprint of the air cleaner 100 can be reduced, allowing for placement of a highly efficient air cleaner in a small space. In addition, the available area of inlet and outlet openings is not limited and therefore the air resistance is reduced.

What is claimed is:

1. A tower ionizer air cleaner, comprising:

a tower chassis, with a base of the tower chassis including a small footprint; one or more airflow inlet openings in the tower chassis;

one or more airflow outlet openings in the tower chassis and substantially opposite to the one or more airflow inlet openings;

an ionizer element positioned within the tower chassis;

two or more fan units located within the tower ionizer air cleaner and affixed to the tower chassis, with the two or more fan units being substantially vertically oriented with respect to each other and being configured to provide an airflow between the one or more airflow inlet openings and the one or more airflow outlet openings and through the ionizer element; and a controller coupled to the two or more fan units and to the ionizer element, with the controller being configured to store current operational settings and automatically recall and resume operation of the air cleaner without user action at the current operational settings upon an electrical power interruption.

2. The air cleaner of claim 1, further comprising:

a control interface adapted to receive user inputs; and the controller coupled to the two or more fan units, to the ionizer element, and to the control interface, with the controller being configured to receive the user inputs from the control interface, operate the two or more fan units and the ionizer element according to the user inputs, and store current operational settings and resume operation of the air cleaner at the current operational settings upon an electrical power interruption.

3. The air cleaner of claim 1, further comprising:

the controller coupled to the two or more fan units and to the ionizer element, with the controller being configured to store current operational settings, operate the two or more fan units at a predetermined kickstart airflow level for a predetermined startup time period after an electrical power interruption, and operate the air cleaner at the stored current operational settings after the predetermined startup time period.

4. The air cleaner of claim 1, further comprising:

the controller coupled to the two or more fan units and to the ionizer element, with the controller being configured to operate the two or more fan units at a predetermined kickstart airflow level for a predetermined startup time period after an electrical power interruption and before recalling the current operation settings if the two or more fan units were operating at a low airflow setting before the electrical power interruption.

5. The air cleaner of claim 1, further comprising a dirty indicator that is actuated upon expiration of a predetermined time period.

6. The air cleaner of claim 4, with the controller being further configured to operate the two or more fan units according to low, medium, and high airflow levels.

7. The air cleaner of claim 4, with the two or more fan units comprising three fan units and with the controller being further configured to operate the three fan units with zero, one, two, or three fan units active.

8. The air cleaner of claim 1, further comprising a filter located in the airflow.

9. The air cleaner of claim 1, wherein the two or more fan units are substantially vertically located in the tower chassis.

10. The air cleaner of claim 1, with the airflow comprising a substantially horizontal airflow.

11. The air cleaner of claim 1, with the ionizer element comprising an electrostatic precipitator.

12. The air cleaner of claim 1, with the ionizer element including a width and a height that is greater than the width.

13. A method of operating a tower ionizer air cleaner, comprising:

receiving user inputs through a control interface;

operating an ionizer element and two or more fan units according to the user inputs, wherein the two or more fan units provide airflow through the ionizer element;

storing current operational settings for the air cleaner; and automatically recalling the current operational settings and resuming operation of the air cleaner without user action at the current operational settings upon an electrical power interruption.

14. The method of claim 13, further comprising:

operating the two or more fan units at a predetermined kickstart airflow level for a predetermined startup time period after the electrical power interruption and before recalling the current operation settings.

15. The method of claim 13, further comprising:

operating the two or more fan units at a predetermined kickstart airflow level for a predetermined startup time period after the electrical power interruption and before recalling the current operation settings if the two or more fan units were operating at a low airflow setting before the electrical power interruption.

16. The method of claim 13, further comprising actuating a dirty indicator upon expiration of a predetermined time period.

17. The method of claim 13, with the operating comprising operating the two or more fan units according to low, medium, and high airflow levels.

18. The method of claim 13, with the two or more fan units comprising three fan units and with the operating comprising operating the three fan units with zero, one, two, or three fan units active.

19. A tower ionizer air cleaner, comprising:

a tower chassis, with a base of the tower chassis including a small footprint; one or more airflow inlet openings in the tower chassis;

one or more airflow outlet openings in the tower chassis and substantially opposite to the one or more airflow inlet openings;

an ionizer element positioned within the tower;

a fan unit located within the tower ionizer air cleaner and affixed to the tower chassis, with the fan unit configured to provide a substantially horizontal airflow between the one or more airflow inlet openings and the one or more airflow outlet openings and through the ionizer element; and a controller coupled to the fan unit and to the ionizer element, with the controller being configured to store current operational settings and automatically recall and resume operation of the air cleaner without user action at the current operational settings upon an electrical power.

20. The air cleaner of claim 19, further comprising:

a control interface adapted to receive user inputs; and the controller coupled to the fan unit, to the ionizer element, and to the control interface, with the controller being configured to receive the user inputs from the control interface, operate the fan unit and the ionizer element according to the user inputs, and store current operational settings and automatically resume operation of the air cleaner without user action at the current operational settings upon an electrical power interruption.

21. The air cleaner of claim 19, further comprising:

the controller coupled to the fan unit and to the ionizer element, with the controller being configured to store current operational settings, operate the fan unit at a predetermined kickstart airflow level for a predetermined startup time period after an electrical power interruption, and operate the air cleaner at the stored current operational settings after the predetermined startup time period.

22. The air cleaner of claim 19, further comprising:

the controller coupled to the fan unit and to the ionizer element, with the controller being configured to operate the fan unit at a predetermined kickstart airflow level for a predetermined startup time period after an electrical power interruption and before recalling the current operation settings if the fan unit was operating at a low airflow setting before the electrical power interruption.

23. The air cleaner of claim 19, further comprising a dirty indicator that is actuated upon expiration of a predetermined time period.

24. The air cleaner of claim 22, with the controller being further configured to operate the fan unit according to low, medium, and high airflow levels.

25. The air cleaner of claim 19, with the fan unit comprising an elongated squirrel cage fan unit.

26. The air cleaner of claim 19, further comprising a filter located in the airflow.

27. The air cleaner of claim 19, wherein the fan unit is substantially vertically located in the tower chassis.

28. The air cleaner of claim 19, with the ionizer element comprising an electrostatic precipitator.

29. The air cleaner of claim 19, with the ionizer element including a width and a height that is greater than the width.

30. A method of operating a tower ionizer air cleaner, comprising:

receiving user inputs through a control interface;

operating an ionizer element and a fan unit according to the user inputs, wherein the fan unit provides a substantially horizontal airflow through the ionizer element; storing current operational settings for the air cleaner; and automatically recalling the current operational settings and resuming operation of the air cleaner without user action at the current operational settings upon an electrical power interruption.

31. The method of claim 30, further comprising:

operating the fan unit at a predetermined kickstart airflow level for a predetermined startup time period after the electrical power interruption and before recalling the current operation settings.

32. The method of claim 30, further comprising:

operating the fan unit at a predetemiined kickstart airflow level for a predetermined startup time period after an electrical power interruption and before recalling the current operation settings if the fan unit was operating at a low airflow setting before the electrical power interruption.

33. The method of claim 30, further comprising actuating a dirty indicator upon expiration of a predetermined time period.

34. The method of claim 30, with the operating comprising operating the fan unit according to low, medium, and high airflow levels.

35. An air cleaner, comprising:

one or more airflow inlet openings in the air cleaner;

one or more airflow outlet openings in the air cleaner;

an ionizer element positioned within the air cleaner; and two or more fan units located within the air cleaner, with the two or more fan units being substantially vertically oriented with respect to each other and configured to provide an airflow between the one or more airflow inlet openings and the one or more airflow outlet openings; and a controller coupled to the two or more fan units and to the ionizer element, with the controller being configured to store current operational settings and automatically recall and resume operation of the air cleaner without user action at the current operational settings upon an electrical power interruption.

36. The air cleaner of claim 35, with the one or more airflow inlet openings and the one or more airflow outlet openings being substantially vertically oriented.

37. The air cleaner of claim 35, with the one or more airflow outlet openings being substantially opposite to the one or more airflow inlet openings.

38. The air cleaner of claim 35, further comprising a tower chassis, with a base of the tower chassis including a small footprint.

39. The air cleaner of claim 35, further comprising an ionizer.

40. The air cleaner of claim 35, further comprising an electrostatic precipitator.

41. An air cleaner, comprising:

one or more airflow inlet openings in the air cleaner; one or more airflow outlet openings in the air cleaner; and an ionizer element positioned within the air cleaner;

three or more fan units located within the air cleaner, with the three or more fan units being configured to provide an airflow between the one or more airflow inlet openings and the one or more airflow outlet openings; and a controller coupled to the three or more fan units and to the ionizer element, with the controller being configured to store current operational settings and automatically recall and resume operation of the air cleaner without user action at the current operational settings upon an electrical power interruption.

42. The air cleaner of claim 41, with the one or more airflow inlet openings and the one or more airflow outlet openings being substantially vertically oriented.

43. The air cleaner of claim 41, with the one or more airflow outlet openings being substantially opposite to the one or more airflow inlet openings.

44. The air cleaner of claim 41, further comprising a tower chassis, with a base of the tower chassis including a small footprint.

45. The air cleaner of claim 41, with the three or more fan units being substantially vertically oriented.

46. The air cleaner of claim 41, further comprising an ionizer.

47. The air cleaner of claim 41, further comprising an electrostatic precipitator.

48. An air cleaner, comprising:

one or more airflow inlet openings in the air cleaner;

one or more airflow outlet openings in the air cleaner;

an ionizer element positioned within the air cleaner;

four or more fan units located within the air cleaner, with the four or more fan units being configured to provide an airflow between the one or more airflow inlet openings and the one or more airflow outlet openings; and a controller coupled to the four or more fan units and to the ionizer element, with the controller being configured to store current operational settings and automatically recall and resume operation of the air cleaner without user action at the current operational settings upon an electrical power interruption.

49. The air cleaner of claim 48, with the one or more airflow inlet openings and the one or more airflow outlet openings being substantially vertically oriented.

50. The air cleaner of claim 48, with the one or more airflow outlet openings being substantially opposite to the one or more airflow inlet openings.

51. The air cleaner of claim 48, further comprising a tower chassis, with a base of the tower chassis including a small footprint.

52. The air cleaner of claim 48, with the four or more fan units being substantially vertically oriented.

53. The air cleaner of claim 48, further comprising an ionizer.

54. The air cleaner of claim 48, further comprising an electrostatic precipitator.

55. A tower air cleaner, comprising:

a tower chassis, with a base of the tower chassis including a small footprint;

one or more airflow inlet openings in the tower chassis, with the one or more airflow inlet openings being substantially vertically oriented in the tower chassis;

one or more airflow outlet openings in the tower chassis, with the one or more airflow outlet openings being substantially vertically oriented in the tower chassis;

an ionizer element positioned within the tower chassis;

two or more fan units located within the tower chassis, with the two or more fan units being substantially vertically oriented with respect to each other and configured to provide an airflow between the one or more airflow inlet openings and the one or more airflow outlet openings; and a controller coupled to the two or more fan units and to the ionizer element, with the controller being configured to store current operational settings and automatically recall and resume operation of the air cleaner without user action at the current operational settings upon an electrical power interruption.

56. The air cleaner of claim 55, with the one or more airflow outlet openings being substantially opposite to the one or more airflow inlet openings.

57. The air cleaner of claim 55, further comprising an ionizer.

58. The air cleaner of claim 55, further comprising an electrostatic precipitator.

* * * * *

UNITED STATES PATENT AND TRADEMARK OFFICE

CERTIFICATE OF CORRECTION

PATENT NO. : 7,713,330 B2
APPLICATION NO. : 11/023113
DATED : December 22, 2004
INVENTOR(S) : Bohlen et al.

It is certified that error appears in the above-identified patent and that said Letters Patent is hereby corrected as shown below:

Title Page:
Item (56) References Cited, OTHER PUBLICATIONS:
Reference entitled "Deluxe Spire Feel-Good Fan with Negative-Ion Feature product Information," change "<URL:http://www.sharperimage.corn/us/en/catalog/productview.jhtml?sku=SI698BRL>" to -- <URL:http://www.sharperimage.com/us/en/catalog/productview.jhtml?sku=SI698BRL> --.
Reference entitled "Ionic Breeze GP Silent Air Purifier with Ultraviolet Germicidal Protection," change "<URL:http://www.sharperimage.corn/us/en/catalog/productview.jhtml?pid=37143300&pcatID=1...>" to -- <URL:http://www.sharperimage.com/us/en/catalog/productview.jhtml?pid=37143300&pcatID=1...> --.

Column 9:
Line 62 (claim 32, line 2), change "predetemiined" to -- predetermined --.

Signed and Sealed this

Seventh Day of September, 2010

David J. Kappos

David J. Kappos
*Director of the United States Patent and Trademark Office*